US008905130B2

(12) United States Patent
Landsiedel

(10) Patent No.: US 8,905,130 B2
(45) Date of Patent: Dec. 9, 2014

(54) FLUID SAMPLE CLEANUP

(75) Inventor: Nathan Landsiedel, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 13/237,214

(22) Filed: Sep. 20, 2011

(65) Prior Publication Data

US 2013/0068463 A1 Mar. 21, 2013

(51) Int. Cl.
*E21B 47/00* (2012.01)
*E21B 49/08* (2006.01)
*E21B 33/124* (2006.01)

(52) U.S. Cl.
CPC ..... *E21B 33/1243* (2013.01); *E21B 49/081* (2013.01)
USPC ..... 166/264; 166/191; 166/250.17

(58) Field of Classification Search
USPC ..... 73/152.01, 152.18; 166/264, 100, 101, 166/191, 250.17
See application file for complete search history.

(56) References Cited

U.S. PATENT DOCUMENTS 4,547,691 A 10/1985 Valdois et al.
4,860,581 A 8/1989 Zimmerman et al.
5,335,732 A * 8/1994 McIntyre ..... 166/313
5,394,345 A 2/1995 Berard et al.
5,799,733 A 9/1998 Ringgenberg et al.
5,803,186 A * 9/1998 Berger et al. ..... 175/50
6,301,959 B1 * 10/2001 Hrametz et al. ..... 73/152.23
6,427,785 B2 8/2002 Ward
6,575,242 B2 6/2003 Woie
7,090,012 B2 * 8/2006 Hill et al. ..... 166/264
7,379,180 B2 * 5/2008 Vannuffelen et al. ..... 356/326
7,578,342 B2 * 8/2009 Brennan et al. ..... 166/191
7,594,541 B2 * 9/2009 Ciglenec et al. ..... 166/250.15
7,647,980 B2 * 1/2010 Corre et al. ..... 166/387
7,762,325 B2 * 7/2010 Ellson et al. ..... 166/187
7,788,972 B2 * 9/2010 Terabayashi et al. ..... 73/152.27
7,874,199 B2 * 1/2011 Chaudoreille et al. ..... 73/32 A
7,934,547 B2 * 5/2011 Milkovisch et al. ..... 166/105
8,015,869 B2 * 9/2011 Nold et al. ..... 73/152.51
2005/0028974 A1 * 2/2005 Moody ..... 166/264
2008/0066535 A1 * 3/2008 Vasques et al. ..... 73/152.17
2011/0139450 A1 * 6/2011 Vasques et al. ..... 166/264

OTHER PUBLICATIONS

International Search Report & Written Opinion issued in PCT/US20121056277 on Feb. 27, 2013; 11 pages.

* cited by examiner

*Primary Examiner* — Jennifer H Gay
*Assistant Examiner* — David Carroll
(74) *Attorney, Agent, or Firm* — Cathy Hewitt; Kenneth Kincaid

(57) ABSTRACT

An apparatus having a body including a plurality of packers and a plurality of ports between the packers. The packers and ports are spaced along a longitudinal axis of the body. The apparatus also includes a control module to obtain a density of a formation fluid and, based on the density, determine a direction to pump fluid from an interval defined by the packers.

19 Claims, 7 Drawing Sheets

FLUID SAMPLE CLEANUP

BACKGROUND OF THE DISCLOSURE

Sampling hydrocarbon fluids from subterranean formations involves positioning a downhole tool in a borehole adjacent a formation, sealing an interval of the borehole along the tool and adjacent the formation and extracting sample fluid from the formation. The sample fluid may then be evaluated (e.g., downhole and/or at the surface of the Earth) to facilitate drilling and/or hydrocarbon production operations.

Prior to collecting a fluid sample for evaluation, the sealed borehole interval is subjected to a cleanup operation during which contaminates such as wellbore fluid (e.g., drilling fluid), filtrate and the like are substantially removed to enable the collection of a substantially uncontaminated formation fluid sample. Some known downhole sampling tools include multiple sampling ports located between packers so that a location within a sampling interval for which cleanup and sampling are performed may be adjusted by selecting a different one of the ports. For example, each of the ports may have a corresponding valve to enable fluid to be drawn from a selected one of the ports. In this manner, the properties of the fluid obtained by each of the ports can be evaluated and one or more of the ports providing the highest quality sample fluid can be selected to collect a sample for further evaluation. Other known downhole sampling tools enable movement of a sampling port within a sample interval to achieve similar results.

However, the above-mentioned known downhole sampling tools include a relatively complex arrangement of valves and flowlines within the sample interval to enable adjustment of the fluid collection port. Such complex valve and flowline arrangements are both costly and create potential failure points within the sample interval.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
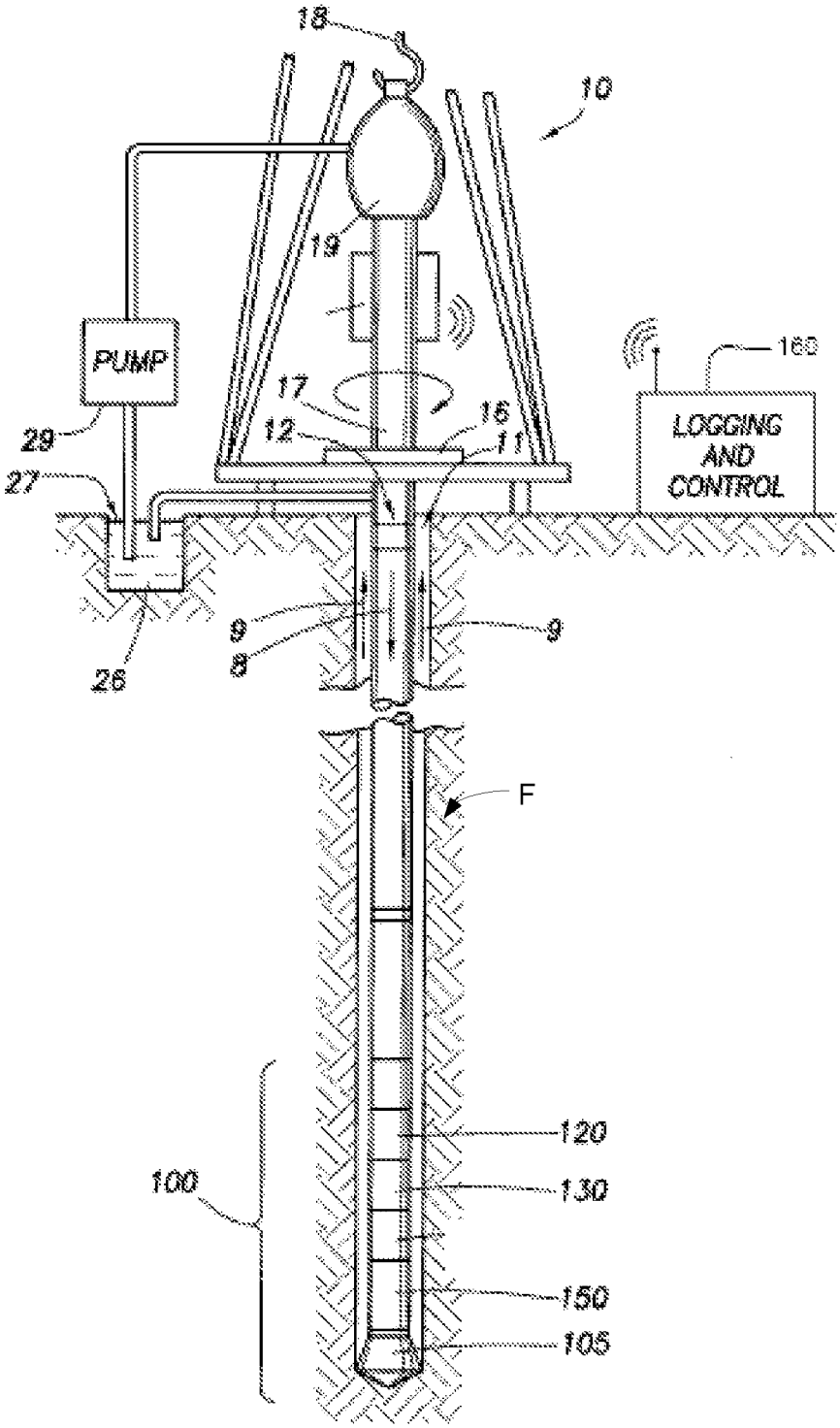
FIG. 1 is a wellsite system according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to methods and apparatus to cleanup downhole fluid samples. The example apparatus and methods described herein may be used to facilitate an efficient and/or effective cleanup of a sample interval and may also simplify the configuration of a sampling tool, particularly in the sample interval between packers. More specifically, the example apparatus and methods described herein recognize that fluids present in a sealed borehole interval and subjected to gravity may segregate in accordance with the different densities of the fluids. For example, where a wellbore fluid has a greater density than a formation fluid, the formation fluid may float or pool on top of (i.e., uphole relative to) the wellbore fluid within an interval that has been sealed off from the remainder of the borehole for sampling. Conversely, where a formation fluid has as greater density than a wellbore fluid, the wellbore fluid floats on top of the formation fluid. In any case, to collect a useful sample of the formation fluid, the volume of contaminated fluid (i.e., the wellbore fluid and/or mixtures of wellbore fluid and formation fluid), which is also commonly referred to as a dead volume, is substantially reduced and a sub-interval (e.g., a sample interval) may then be established by sealing off an interval of the borehole within an already established guard interval. A substantially uncontaminated or clean formation fluid sample may then be extracted from the sample interval.

In contrast to the above-mentioned known apparatus and methods, some of the example apparatus and methods described herein determine the manner in which fluids within a sealed borehole interval segregate in the presence of gravity and then select a direction (i.e., uphole or downhole) to pump fluid from a flowline fluidly coupled to the sealed borehole interval to most efficiently and effectively eliminate the sump to clean the sealed interval. In particular, the example apparatus and methods may estimate or determine a density of a formation fluid relative to a wellbore fluid and, based on a comparison of the densities of these fluids, select a pumping direction to perform a cleanup operation. For example, in a case where the density of the formation fluid is lower than the wellbore fluid, the formation fluid floats on top of the wellbore fluid and pumping fluid from the sealed interval via a flowline in a downhole direction can facilitate efficient and effective cleanup as well as enable simplification of the valving and flowline configuration of the downhole sampling tool. Alternatively, in the case where the density of the formation fluid is greater than the wellbore fluid, the wellbore fluid floats on top of the formation fluid and pumping fluid from the sealed interval via a flowline in an uphole direction can facilitate efficient and effective cleanup as well as the enable the simplification of the sampling tool. In the case where a density is estimated, such an estimate may be based on prior knowledge relating to a wellbore or formation fluid type and/or density.

Alternatively, the example apparatus and methods described herein may determine the manner in which fluids segregate within a sealed borehole interval using fluid properties other than density. For example, optical measurements, resistivity measurements, and/or viscosity measurements may be used to determine the type(s) of fluid(s) in the borehole. Once the fluid types are known, the manner in which the fluids segregate can be determined and an appropriate pumping direction can be selected.

Still further, the example apparatus described herein may alternatively or additionally utilize two pumps, one pump above a sealed borehole interval and another pump below the interval, to pump fluids from the interval in the uphole direction and downhole direction at the same time. In this example, the pumping may occur without regard to the relative densities or types of any fluids in the sealed interval. Instead, this example relies on the fact that fluids of different densities naturally segregate in a sealed borehole interval.

In one particular example described herein, a downhole sampling tool has a plurality of packers and inlet ports spaced along a longitudinal axis of a body of the tool. First and fourth packers (e.g., guard packers) may be inflated to establish or seal a first borehole interval and second and third packers located within the first interval or between the first and fourth packers may be inflated to establish or seal a second borehole or sample interval within the first interval. In this manner, the first and second packers may be used to define a first guard interval, the third and fourth packers may be used to define a second guard interval and the second and third packers may be used to define the sample interval between the first and second guard intervals. A first one of the ports may be positioned between the first and second packers (i.e., in the first guard interval), a second one of the ports may be positioned between the second and third packers (i.e., in the sample interval) and the third port may be positioned between the third and fourth packers (i.e., in the second guard interval). A flowline may fluidly couple the first and third ports. Additionally, a first pump within the downhole tool may be positioned uphole relative to the packers and may be selectively fluidly coupled to the flowline via a first valve. Similarly, a second pump within the downhole tool may be positioned downhole relative to the packers and may be selectively fluidly coupled to the first flowline via a second valve.

In operation, a controller may operate the first pump or the second pump based on a comparison of a formation fluid density to a wellbore fluid density to perform a cleanup operation and to collect a formation fluid sample. For example, the first and fourth packers may be inflated to seal the first interval and the controller may determine that the density of the formation fluid to be collected is less than the density of the wellbore fluid. Thus, the formation fluid is floating on top of the dead volume (i.e., the wellbore fluid and/or any mixture of wellbore fluid and formation fluid). The controller may then operate the second pump, which is downhole relative to the packers and ports, to pump fluid from the first interval via the flowline in the downhole direction. By pumping fluid via the flowline in the downhole direction, fluid is drawn into both the first and third ports at the same time, and wellbore fluid may be drawn via the lower or third port at least until the wellbore fluid/formation fluid interface reaches the lower or third port but may be drawn via the lower or third port. In this manner the continued pumping in the downhole direction tends to eliminate the sump and substantially clean the first interval. Once the controller recognizes that the sump has been substantially eliminated (i.e., that the first interval is substantially clean), the second and third packers may be inflated to establish the sample interval around the second port. A focused sampling may then be performed by using one of the first and second pumps to extract formation fluid via the middle or second port, and the other of the first and second pumps to extract mud filtrate or other contaminated fluid via the lower or first port and the upper or third port at the same time.

In a case where the controller determines that the density of the formation fluid is greater than the density of the wellbore fluid, the dead volume floats on top of the formation fluid. In this case, the controller may then operate the first pump to pump fluid from the first and third ports via the flowline in the uphole direction. By pumping in the uphole direction, wellbore fluid may be drawn via the first or upper port at least until the wellbore fluid/formation fluid interface reaches the first or upper port, thereby tending to eliminate the sump to clean the first interval. Again, once the controller recognizes that the sump has been substantially eliminated, the second and third packers may be inflated to establish the sample interval and focused sampling may be performed.

One or more aspects of the present disclosure, such as changing the pumping direction based on the relative densities of a formation fluid and a wellbore fluid present in a sealed borehole interval, may enable efficient and effective cleanup of the sealed interval. One or more aspects of the present disclosure, such as enabling the pumping direction to be changed to establish a flow path from a plurality of ports fluidly coupled to a common flowline, may enable the elimination of valves and/or other fluid flow control devices in the portions of the flowline within the sealed borehole interval, which may reduce complexity of the sampling tool, improve the environmental robustness of the tool, and/or reducing the cost of the sampling tool.

One or more aspects of the present disclosure, such as examples described herein utilizing four or more packers, may enable improved efficiency or effectiveness of the isolation of formation fluid from mud filtrate, wellbore fluid or other contaminated fluid, such as may be due to the further isolation of the inner sample interval by the surrounding guard intervals. For example, once the sump has been cleaned and the inner sample interval is established, mud filtrate, wellbore fluid or other contaminated fluid may be substantially prevented from entering the middle or second port during the focused sampling operation. In contrast, for examples having only two packers that define a single interval during both the cleanup operation and the sample collection operation, formation fluid can conceivably enter the interval at any point along the length of the interval. As a result, in a case where the formation fluid is less dense than the wellbore or sump fluid, formation fluid that enters the sealed interval where an amount of sump fluid remains may bubble up or float up through the remaining sump fluid and become contaminated before being collected at the top of the interval. In contrast, for examples having four or more packers, the guard intervals surround and, thus, isolate the inner sample interval. As a result, any mud filtrate that enters from above and below the isolated inner sample interval may be captured in the guard intervals, thereby maintaining a high fluid quality (i.e., low contamination level) in the inner sample interval.

While the particular example mentioned above employs two pumps, one of which is positioned uphole relative to the packers and ports and another that is positioned downhole relative to the packers and ports, the apparatus and methods described herein can also be implemented using a single pump. Such single pump configurations include flowlines and valves to selectively change the direction in which fluid is drawn from a sealed borehole interval via a flowline coupling two or more ports. More generally, regardless of the number and/or type of devices used to extract fluid from a sealed borehole interval containing gravitationally segregated fluids, the direction in which fluid flows through a flowline coupling inlet ports longitudinally spaced along the interval may determine the port at which the wellbore fluid/formation fluid interface will stabilize, and therefore the amount of sump fluid remaining in the sealed interval after cleanup of the sealed interval. When pumping fluid through a flowline in an uphole direction, an uppermost port coupling the flowline to the sealed borehole interval may draw the lightest of segregated fluids from the sealed borehole interval, and thus may efficiently or effectively cleanup a sump of wellbore fluid lighter or less dense than formation fluid from the sealed interval. Conversely, when pumping fluid through the flowline in a downhole direction, a lowest port coupling the flowline to the sealed borehole interval may draw the heaviest of segregated fluids from the sealed borehole interval, and thus may efficiently or effectively cleanup a sump of wellbore fluid heavier or denser than formation fluid from the sealed interval. Therefore, in cases where wellbore and formation fluid segregate by gravity, controlling the pumping direction or direction of fluid flow in the flowline coupling the ports may ensure that the sump of wellbore fluid initially trapped in the sealed interval can be substantially eliminated.

FIG. 1 depicts a wellsite system including downhole tool(s) according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally or alternatively, a top drive system could be used.

In the example depicted in FIG. 1, the surface system further includes drilling fluid 26, which is commonly referred to in the industry as mud, and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
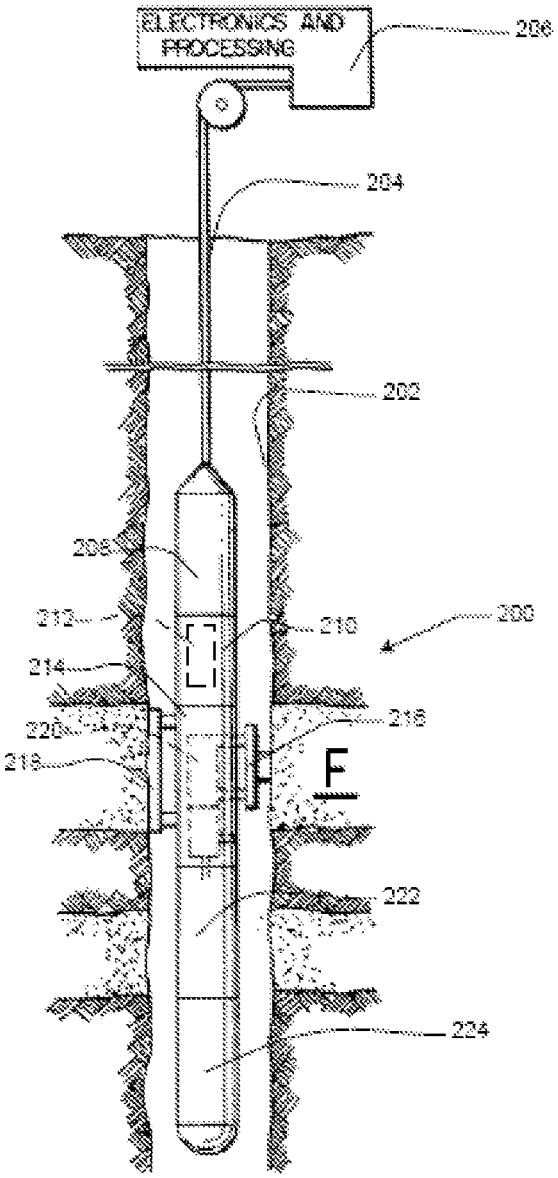
FIG. 2 is a wireline system according to one or more aspects of the present disclosure.

FIG. 2 depicts an example wireline system including downhole tool(s) according to one or more aspects of the present disclosure. The example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a collar 210 having a tool control system 212 configured to control extraction of formation fluid from a formation F and measurements performed on the extracted fluid.

The wireline tool 200 also includes a formation tester 214 having a selectively extendable fluid admitting assembly 216 and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

One or more modules or tools of the example drill string 12 shown in FIG. 1 and/or the example wireline tool 200 of FIG. 2 may employ the example methods and apparatus described herein. While the example apparatus and methods described herein are described in the context of drillstrings and/or wireline tools, they are also applicable to any number and/or type(s) of additional and/or alternative downhole tools such as coiled tubing deployed tools. Further, one or more aspects of this disclosure may also be used in other coring applications such as side-wall and/or in-line coring.

Figure 3:
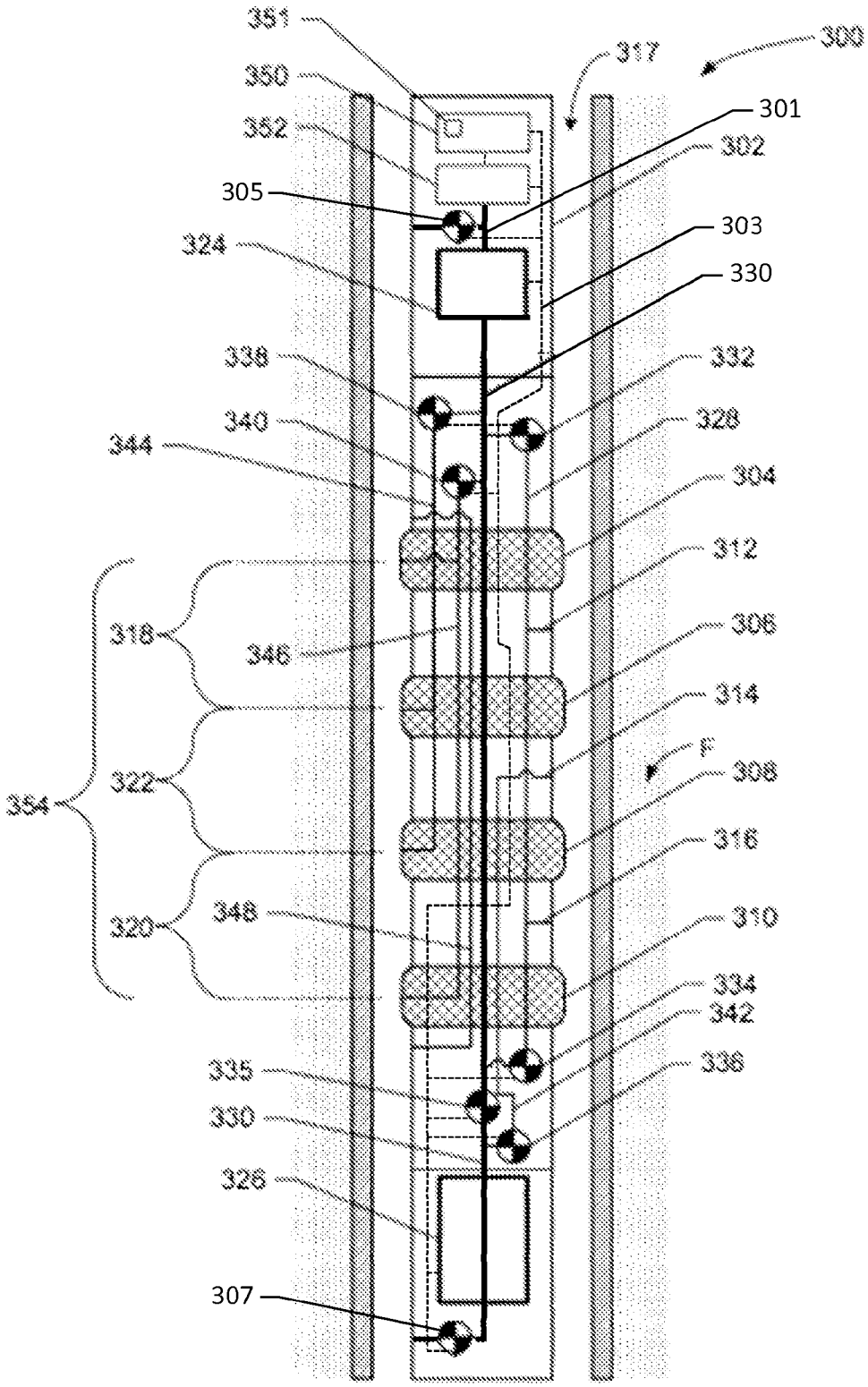
FIG. 3 is a schematic view of apparatus according to one or more aspects of the present disclosure.

FIG. 3 depicts an example downhole tool 300 that may be used to perform formation fluid sampling operations. The downhole tool 300 is shown in simplified schematic form for purposes of clarity. However, it should be understood that various known techniques and apparatus for interconnecting and/or controlling the apparatus shown in FIG. 3 may be employed as needed to implement the examples described in more detail below. For example, the downhole tool 300 includes a controller or control module 350, wherein connection means fluidly connect (as depicted in FIG. 3 by solid line 301) and/or electrically connect (as depicted in FIG. 3 by dotted lines 303) the controller or control module 350 to various components described below. Of course, the connection means 301 and 303 that are schematically depicted in FIG. 3 are merely examples of myriad other connection means that are also within the scope of the present disclosure.

The downhole tool 300 has a body 302 including first through fourth packers 304, 306, 308, and 310 and first through third inlet ports 312, 314, and 316. In the example of FIG. 3, the downhole tool 300 is depicted as being positioned in a borehole 317 adjacent a subterranean formation F from which a fluid sample is to be collected. The packers 304, 306, 308, and 310 and the ports 312, 314, and 316 are spaced along a longitudinal axis of the body 302 so that the first and second packers 304 and 306 define a first guard interval 318, the third and fourth packers 308 and 310 define a second guard interval 320, and the second and third packers 306 and 308 define a sample interval 322 between the first and second guard intervals 318 and 320. The first port 312 is positioned in the first guard interval 318, the second port 314 is positioned in the sample interval 322, and the third port 316 is positioned in the second guard interval 320. As described in more detail below, the packers 304, 306, 308, and 310 may be selectively inflated to establish one or more sealed intervals along the borehole 317 and adjacent the formation F.

To inflate and/or deflate the packers 304, 306, 308, and 310 and to collect or extract fluid from the interval(s) defined by the packers 304, 306, 308, and 310 via the ports 312, 314, and 316, the tool 300 includes first and second pumps 324 and 326. The first pump 324 is positioned uphole relative to the packers 304, 306, 308, and 310 and the ports 312, 314, and 316 and may be selectively fluidly coupled to a first flowline 328. As shown in FIG. 3, the first flowline 328 functions as a common flowline that fluidly couples the first and third ports 312 and 316 without any valves or other flow control apparatus within the intervals 318, 320, and 322 defined by the packers 304 306, 308, and 310. The second pump 326 within the downhole tool 300 is positioned downhole relative to the packers 304, 306, 308, and 310 and the ports 312 314, and 316 and may be selectively fluidly coupled to the first flowline 328.

The pumps 324 and 326 are coupled to a main or second flowline 330 that is fluidly coupled to first through sixth valves 332, 334-336, 338, and 340. In operation, the first pump 324 may be selectively fluidly coupled to the first flowline 328 and, thus, the first and third ports 312 and 316 by opening/closing the first valve 332. Similarly, the second pump 326 may be selectively fluidly coupled to the first flowline 328 and, thus, the first and third ports 312 and 316 by opening/closing the second valve 334 and the third valve 335. The fourth valve 336 may be opened/closed to selectively fluidly couple the second pump 326 to a third flowline 342 and, thus, the second port 314. The fifth valve 338 may be opened/closed to selectively fluidly couple the first pump 324 to a fourth flowline 344, which conveys fluid to/from the second and third packers 306 and 308. Similarly, the sixth valve 340 may be opened/closed to selectively fluidly couple the first pump 324 to a fifth flowline 346, which conveys fluid to/from the first and fourth packers 304 and 310. A sixth flowline 348 functions as a bypass line that may be used to equalize pressure below the fourth packer 310 and above the first packer 304.

As described above, the example downhole tool 300 also includes the controller 350. The controller 350 has a memory 351. The controller 350 may be used to control the operation of the pumps 324 and 326 and the valves 332, 334-336, 338, and 340 to perform cleanup operations and fluid sampling operations. The tool 300 may also include a fluid analysis module 352 that may interoperate with the controller 350 to measure one or more characteristics of fluid(s) within the borehole.

The example downhole tool 300 is merely one configuration that may be used to implement the teachings of this disclosure. For example, while the third flowline 342 for the second port 314 is depicted as being directed to the lower end of the tool 300, the flowline 342 could instead be routed toward the upper portion of the tool 300. In that case, the fourth valve 336 may also be located in the upper portion of the tool 300. Similarly, while the fifth and sixth valves 338 and 340 are shown as being located in the upper portion of the tool 300, these valves could instead be located in the lower portion of the tool 300 or split between the upper and lower portions of the tool 300. More generally, any desired arrangement of valves and flowlines may be used without departing from the scope of this disclosure.

Figure 4:
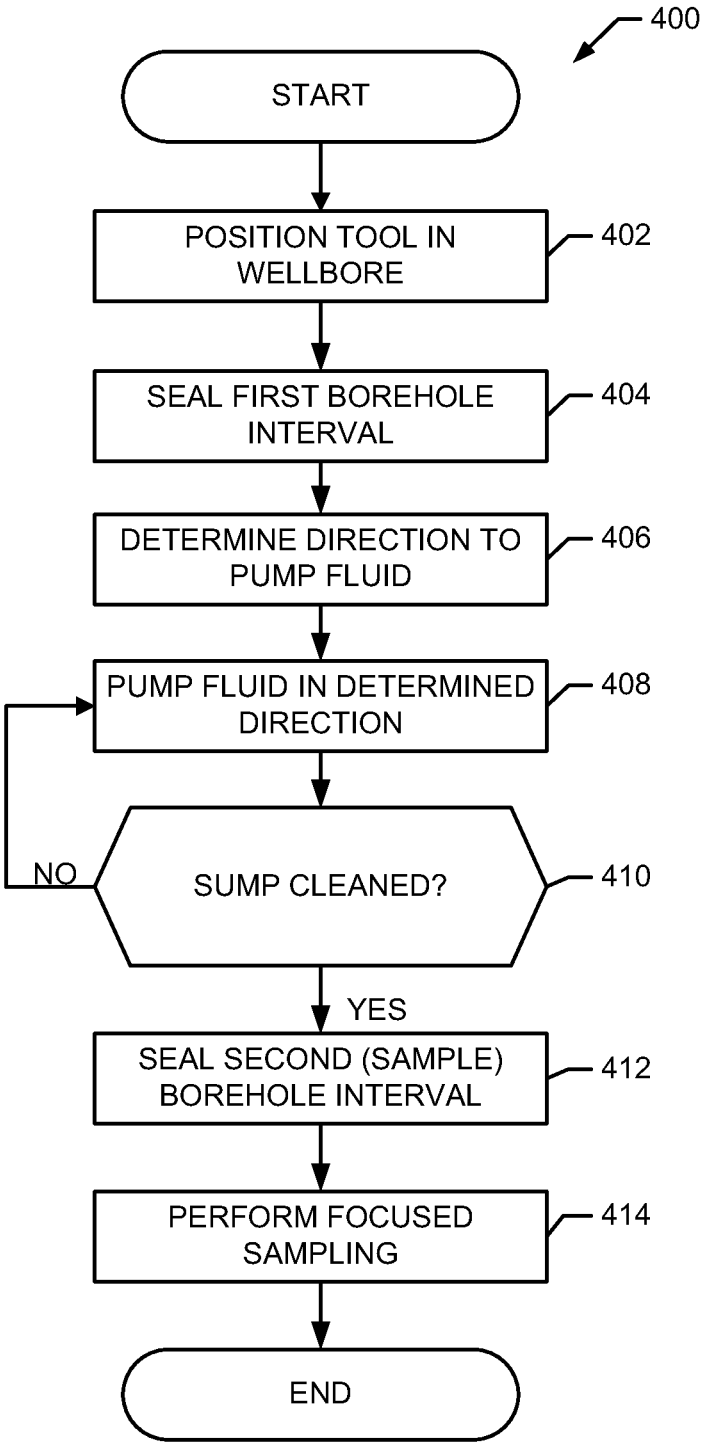
FIG. 4 is a flowchart of a method according to one or more aspects of the present disclosure.

FIG. 4 is a flow diagram depicting an example method 400 that may be implemented with the example tool 300 of FIG. 3. The method 400 begins with positioning the example downhole tool 300 in the borehole 317 adjacent the formation F (block 402). The controller 350 then controls the sixth valve 340 to fluidly couple the fifth flowline 346 to the first and fourth packers (i.e., guard packers) 304 and 310 and operates the first pump 324 to inflate the first and fourth packers 304 and 310 to seal a first interval 354 (FIG. 3) of the borehole 317 (block 404).

The controller 350 then determines a direction to pump fluid from the first interval 354 based on a density of a formation fluid from the formation F (block 406) and then pumps the fluid in the determined direction as set forth in more detail below (block 408). The pumping direction determination at block 408 may be made by comparing the density of the formation fluid to the density of the wellbore fluid in the first interval 354. Initially, the controller 350 may obtain the density of the formation fluid from a value determined previously using a probe sampling tool and stored in the memory 351 accessible by the controller 350. The controller 350 may also obtain the density of the wellbore fluid by accessing, for example, a known wellbore fluid density value that has been stored in the memory 351.

If the controller 350 determines that the density of the formation fluid is less than the density of the wellbore fluid, then the controller 350 determines that the pumping direction for the first flowline 328 is downhole. In that case, the controller operates the second valve 334 and third valve 335 to fluidly couple the first flowline 328 to the second pump 326 and controls the second pump 326 to pump or draw fluid from the first interval 354 through the first flowline 328 and, thus, the first and third ports 312 and 316 in the downhole direction, such as through a downhole valve 307 also controlled by the controller 350.

Figure 5:
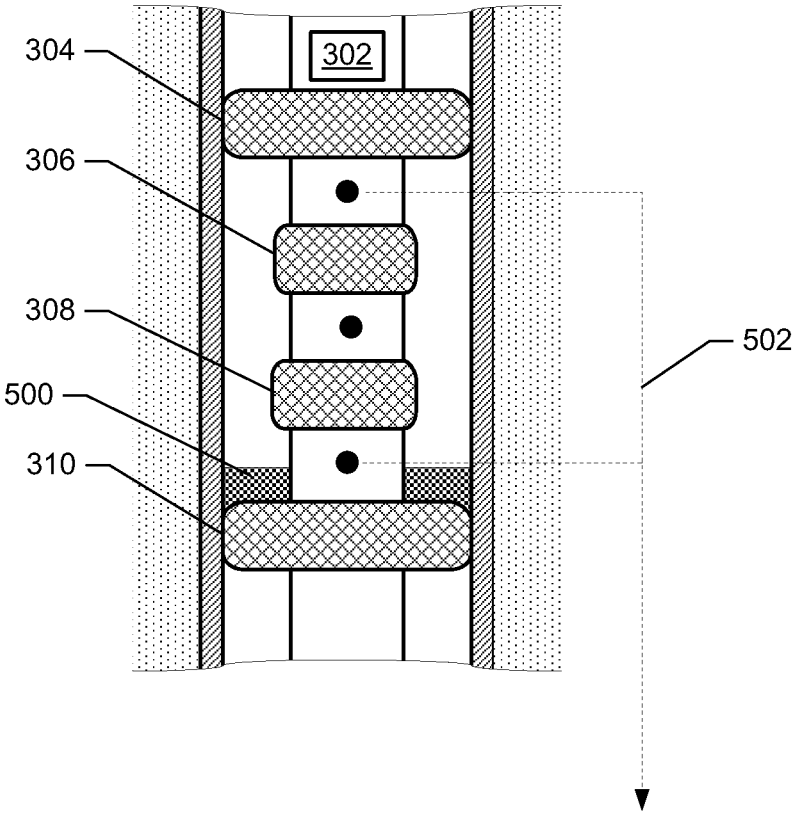
FIG. 5 is another schematic view of apparatus according to one or more aspects of the present disclosure.
Figure 6:
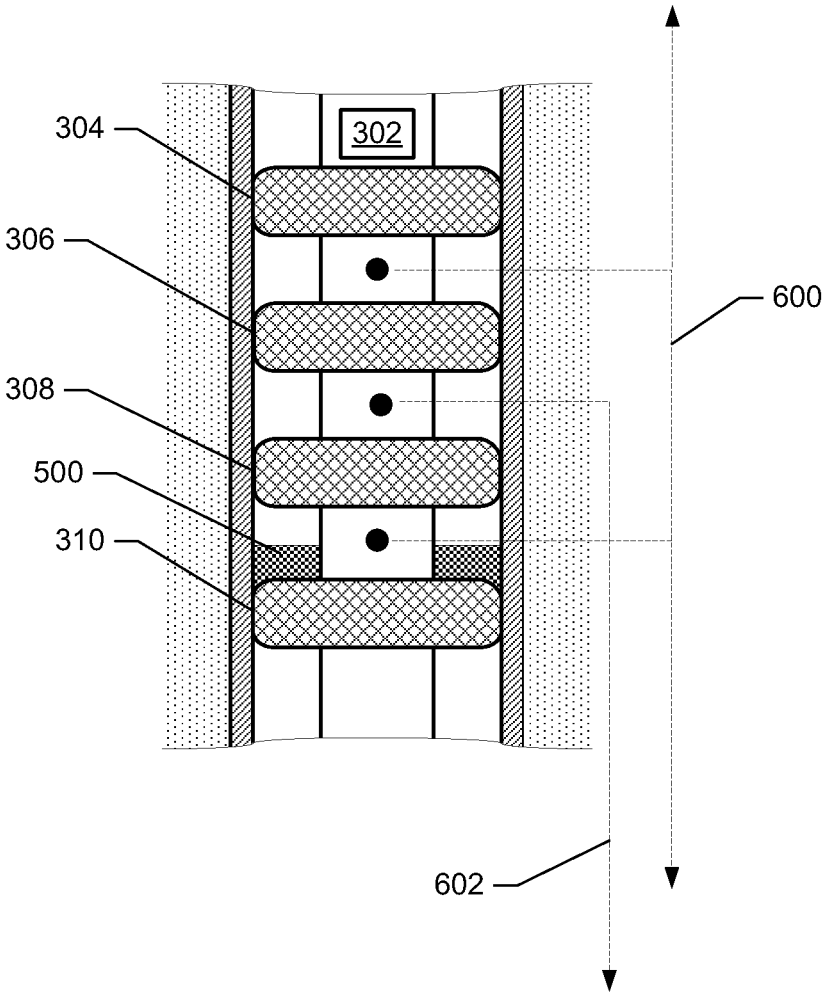
FIG. 6 is another schematic view of apparatus according to one or more aspects of the present disclosure.

Turning briefly to FIG. 5, the effect of continued pumping in the downhole direction (via a path or direction 502 shown in dashed lines and in the direction of the arrow) substantially cleans the interval, leaving only a small amount of sump fluid (i.e., wellbore fluid) 500 near the bottom of the interval. Returning to FIGS. 3 and 4, during the pumping operation, the controller 350 may monitor the condition of the fluid extracted via the first flowline 328 using, for example, the fluid analyzer 352 to determine if the sump is sufficiently cleaned (block 410). The condition of the fluid extracted via the first flowline 328 may indicate the presence of or a sufficient concentration of a formation fluid, thereby indicating that the sump has been sufficiently cleaned. If the sump has been sufficiently cleaned, the controller 350 may then operate the fifth valve 338 to inflate the second and third packers 306 and 308 to establish the sample interval 322, which is surrounded by the first and second guard intervals 318 and 320 (block 412). Once the sample interval 322 has been established, the controller 350 may then operate the fourth valve 336 to fluidly couple the third flowline 342 to the second pump 326 to perform a focused sampling operation (block 414). FIG. 6 depicts such a focused sampling operation in which the sump is cleaned via a path or direction 600 shown in dashed lines and in the direction(s) of the arrow(s) and where the sampling is performed via a path or direction 602.

Figure 7:
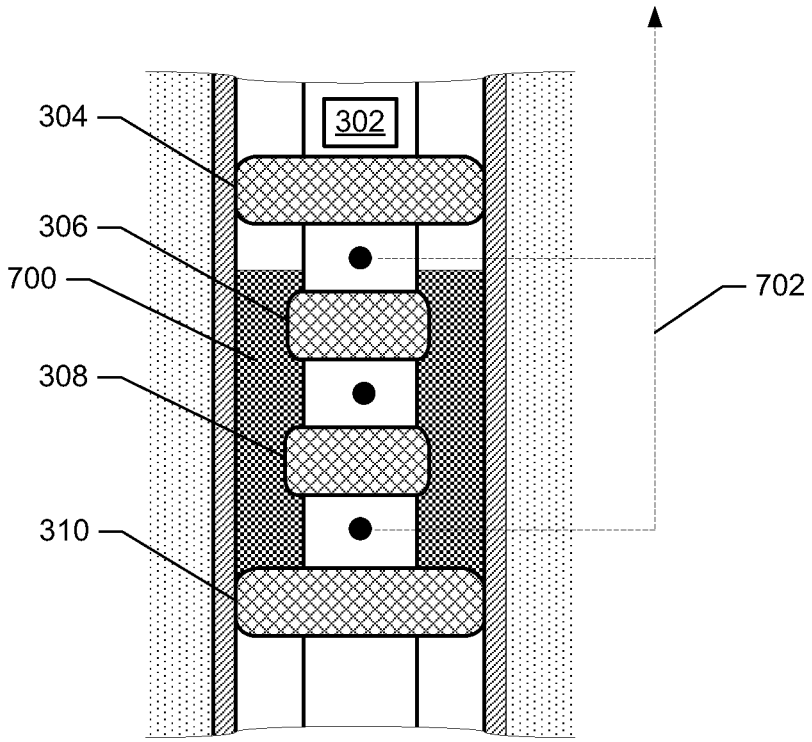
FIG. 7 is another schematic view of apparatus according to one or more aspects of the present disclosure.

If, at block 406, the controller 350 determines that the formation fluid is heavier or denser than the wellbore fluid, the controller 350 determines that the pumping direction for the first flowline 328 and the first and third ports 312 and 316 is uphole rather than downhole. In that case the controller 350 operates the first pump 324, an uphole valve 305, and the first valve 332 rather than the second pump 326, the downhole valve 307, and the second valve 334 to clean the first interval 354 prior to performing the focused sampling operation at block 414. FIG. 7 depicts a scenario including such a relatively dense formation fluid 700 in which fluid is pumped via a path or direction 702.

Although not shown in FIG. 4, the example method 400 may also change the pumping direction in response to detecting a change in the relative densities of a formation fluid and a wellbore fluid. For example, in the case where one or more of the fluid densities have been estimated and the controller 350 determines an actual density (e.g., using the fluid analyzer 352) is sufficiently different from an estimate to require a change in the pumping direction, the controller 350 may then change the pumping direction. For example, the controller 350 may initially obtain a formation fluid density (e.g., either based on an initial measurement and/or stored data associated with a formation being sampled) that is greater than a wellbore fluid density, thereby resulting in the controller 350 determining to pump from the first flowline 328 in an uphole direction. Then during the cleanup operation at blocks 408-410, the controller 350 may determine that the formation fluid density is actually less than the wellbore fluid density, thereby causing the controller 350 to change the pumping direction to a downhole direction.

While the example described above in connection with FIG. 4 determines or selects a pumping direction based on a formation fluid density, another characteristic or characteristics of the formation and/or wellbore fluid may be used instead. For example, the pumping direction may be based on fluid type(s), viscosities, optical characteristics, etc. of the fluid in the first interval 354. Additionally or alternatively, the first interval 354 may be cleaned by operating both pumps 324 and 326 at the same time to pump fluid from the interval 354 uphole and downhole at the same time. In this manner, characteristics of the fluid in the sealed interval 354 do not have to be estimated, measured, etc. Instead, the fact that fluids having different densities will have segregated in the interval 354 ensures that the different fluids are substantially pumped in opposing directions, thereby substantially cleaning the interval 354.

While the foregoing examples are described in connection with downhole sampling tools having a quad packer configuration, the examples described herein may be used with tools having fewer than or more than four packers. Additionally, while the examples described herein may be particularly advantageous when employed in connection with sampling tools or operations, the examples described herein may be used in connection with any other types of tools and/or operations.

The foregoing disclosure introduces a downhole tool having a body including a plurality of packers and a plurality of ports between the packers. The packers and the ports are spaced along a longitudinal axis of the body. The downhole tool also includes a control module to obtain a density of a formation fluid and, based on the density, determine a direction to pump fluid from a borehole interval defined by the packers.

The disclosure also introduces a downhole tool having a body including first, second, third and fourth packers, and first, second and third ports. The packers are spaced along the body of the tool so that the first and second packers are to define a first guard interval, the third and fourth packers are to define a second guard interval and the second and third packers are to define a sample interval between the first and second guard intervals. The first port is positioned in the first guard interval, the second port is positioned in the sample interval and the third port is positioned in the second guard interval. The downhole tool also includes a first flowline fluidly coupling the first and third ports, a first pump within the downhole tool to be selectively fluidly coupled to a first flowline and a controller to operate the first pump to pump fluid from the first flowline in a direction based on a comparison of a formation fluid density to a wellbore fluid density.

The disclosure further introduces a method involving positioning a downhole tool in a borehole adjacent a formation where the downhole tool has a plurality of packers and a plurality of ports spaced along a body of the tool between the packers. The method also involves sealing a first interval of the borehole using two of the packers, determining a direction to pump fluid from the first interval through a flowline fluidly coupling two of the ports based on a density of a formation fluid, where the two ports are in fluid communication with the first interval, and pumping fluid from the first interval through the flowline in the determined direction.

The disclosure further introduces an apparatus including a downhole tool having a body including a plurality of packers and a plurality of ports between the packers. The packers and the ports are spaced along a longitudinal axis of the body. The apparatus also includes a first pump disposed in the downhole tool, a second pump disposed in the downhole tool, and a control module. The control module is to cause the first pump to pump a first fluid from a sealed borehole interval defined by the packers in an uphole direction and to cause the second pump to pump a second fluid from the sealed borehole interval in a downhole direction while the first pump pumps the first fluid. The first and second fluids have different respective densities.

The present disclosure also introduces an apparatus comprising: a downhole tool having a body including a plurality of packers and a plurality of ports between the packers, the packers and the ports spaced along a longitudinal axis of the body; and a controller to obtain a density of a formation fluid and, based on the density, determine a direction to pump fluid from a borehole interval defined by the packers. The controller may be to operate a pump to pump fluid through a flowline in an uphole direction or a downhole direction based on the density of the formation fluid, the flowline being simultaneously fluidly coupled to two of the ports and the borehole interval. The controller may also or alternatively be to operate the pump to pump fluid through the flowline in the downhole direction when the density of the formation fluid is less than a density of a wellbore fluid in the borehole interval. The controller may also or alternatively be to operate the pump to pump fluid through the flowline in the uphole direction when the density of the formation fluid is greater than a density of a wellbore fluid in the borehole interval. The controller may also or alternatively be to obtain the density of the formation fluid by causing the downhole tool to sample fluid in the borehole interval. The packers may comprise four packers spaced along the longitudinal axis of the downhole tool, wherein the packers may be to define two guard intervals and a sample interval between the guard intervals, and wherein a first one of the ports may be positioned in one of the guard intervals, a second one of the ports may be positioned in the other guard interval, and a third one of the ports may be positioned in the sample interval. The apparatus may further comprise a flowline fluidly coupling the two ports positioned in the guard intervals, and the flowline may have no valves between the two ports. The plurality of packers may comprises first, second, third and fourth packers spaced along the body of the tool so that the first and second packers may be to define a first guard interval, the third and fourth packers may be to define a second guard interval, and the second and third packers may be to define a sample interval between the first and second guard intervals; the plurality of ports may comprise first, second and third ports, wherein the first port may be positioned in the first guard interval, the second port may be positioned in the sample interval, and the third port may be positioned in the second guard interval; the apparatus may further comprise a flowline fluidly coupling the first and third ports; the apparatus may further comprise a pump positioned within the downhole tool and selectively fluidly coupled to the flowline; and the controller may be to operate the pump to pump fluid from the flowline in a direction based on a comparison of the formation fluid density to a wellbore fluid density. The pump may be a first pump positioned uphole relative to the packers; the apparatus may further comprise a second pump positioned within the downhole tool in a position downhole relative to the packers; the second pump may be selectively fluidly coupled to the flowline; and the controller may be to operate the first pump or the second pump based on the comparison of the formation fluid density to the wellbore fluid density. The controller may be to operate the first pump when the comparison indicates the formation fluid has a greater density than the wellbore fluid, and wherein the controller may also or alternatively be to operate the second pump when the comparison indicates the wellbore fluid has a greater density than the formation fluid. The first pump may be selectively fluidly coupled to the first flowline via a first valve positioned above the packers, and the second pump may be selectively fluidly coupled to the first flowline via a second valve positioned below the packers.

The present disclosure also introduces a method comprising: positioning a downhole tool in a borehole adjacent a formation, wherein the downhole tool comprises: a plurality of packers spaced along a body of the tool; and a plurality of ports positioned between ones of the plurality of packers; sealing a first interval of the borehole using two of the plurality of packers; determining, based on a density of a formation fluid, a direction to pump fluid from the first interval through a flowline fluidly coupling two of the plurality of ports that are in fluid communication with the first interval; and pumping fluid from the first interval through the flowline in the determined direction. The method may further comprise determining a condition of the fluid in the first interval and, based on the condition of the fluid: using another two of the plurality of packers to seal a second interval of the borehole within the first interval; and pumping fluid from the second interval to collect a fluid sample from the formation. Determining the direction to pump fluid from the first interval based on the density of the formation fluid may comprise comparing the density of the formation fluid to a density of a wellbore fluid and determining to pump the fluid through the flowline in an uphole direction when the density of the formation fluid is greater than the density of the wellbore fluid. Pumping the fluid from the first interval in the determined direction may comprise activating a first pump positioned uphole relative to the packers or activating a second pump positioned downhole relative to the packers. Pumping the fluid from the first interval in the determined direction may comprise pumping the fluid via at least two of the ports in the first interval at the same time, wherein the at least two ports may be associated with respective guard intervals within the first interval. The method may further comprise measuring a property of a fluid in the first interval and changing the direction to pump the fluid based on the measured property.

The present disclosure also introduces an apparatus comprising: a downhole tool having a body including a plurality of packers and a plurality of ports between the packers, the packers and the ports spaced along a longitudinal axis of the body; a first pump disposed in the downhole tool; a second pump disposed in the downhole tool; and a control module to cause the first pump to pump a first fluid from a sealed borehole interval defined by the packers in an uphole direction and to cause the second pump to pump a second fluid from the sealed borehole interval in a downhole direction while the first pump pumps the first fluid, the first and second fluids having different respective densities. The first pump may be disposed in the downhole tool uphole from the packers and the second pump may be disposed in the downhole tool downhole from the packers. The packers may comprise four packers.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. §112, paragraph 6 for any limitations of any of the claims herein, except for those in which the claim expressly uses the words "means for" together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool having a body including a plurality of packers and a plurality of ports between the ones of the plurality packers, the plurality of packers and the plurality of ports spaced along a longitudinal axis of the body;

a controller to obtain a density of a formation fluid and, based on the density, determine a direction to pump the formation fluid relative to a borehole interval defined by ones of the plurality of packers;

a first pump located uphole relative to the plurality of packers;

a second pump located downhole relative to the plurality of packers; and a flowline simultaneously fluidly coupled to at least two of the plurality of ports that are each positioned in the borehole interval, wherein:

the first and second pumps are selectively fluidly coupled to the flowline;

the controller is operable to operate the first pump to pump the formation fluid through the flowline in an uphole direction when the obtained density of the formation fluid is greater than a density of a wellbore fluid in the borehole interval; and the controller is operable to operate the second pump to pump the formation fluid through the flowline in a downhole direction when the obtained density of the formation fluid is less than the density of the wellbore fluid in the borehole interval.

2. The apparatus of claim 1 wherein the controller is to obtain the density of the formation fluid by causing the downhole tool to sample fluid in the borehole interval.

3. The apparatus of claim 1 wherein the plurality of packers comprises four packers spaced along the longitudinal axis of the downhole tool, wherein the four packers are to define two guard intervals and a sample interval between the guard intervals, and wherein a first one of the plurality of ports is positioned in one of the guard intervals, a second one of the plurality of ports is positioned in the other guard interval, and a third one of the plurality of ports is positioned in the sample interval.

4. The apparatus of claim 3 wherein the flowline fluidly connects the two ports positioned in the guard intervals, and wherein the flowline has no valves between the two ports.

5. The apparatus of claim 1 wherein:

the plurality of packers comprises first, second, third and fourth packers spaced along the body of the tool so that the first and second packers are to define a first guard interval, the third and fourth packers are to define a second guard interval, and the second and third packers are to define a sample interval between the first and second guard intervals;

the plurality of ports comprises first, second and third ports, wherein the first port is positioned in the first guard interval, the second port is positioned in the sample interval, and the third port is positioned in the second guard interval; and the flowline fluidly couples the first and third ports.

6. The apparatus of claim 1 wherein the first pump is to be selectively fluidly coupled to the flowline via a first valve positioned above the plurality of packers and the second pump is to be selectively fluidly coupled to the flowline via a second valve positioned below the plurality of packers.

7. The apparatus of claim 1 wherein:

the first pump pumps the fluid out of the downhole tool into the borehole at a location above the plurality of packers; and the second pump pumps the fluid out of the downhole tool into the borehole at a location below the plurality of packers.

8. The apparatus of claim 1 wherein the controller does not operate either the first pump or the second pump to pump the formation fluid in the uphole direction when the obtained density of the formation fluid is less than the density of the wellbore fluid in the borehole interval, and does not operate either the first pump or the second pump to pump the formation fluid in the downhole direction when the obtained density of the formation fluid is greater than the density of the wellbore fluid in the borehole interval.

9. The apparatus of claim 1 wherein:

the controller is operable to obtain the density of the formation fluid by causing the downhole tool to sample fluid in the borehole interval;

the plurality of packers define two guard intervals and a sample interval between the guard intervals;

a first one of the plurality of ports is positioned in a first one of the guard intervals;

a second one of the plurality of ports is positioned in a second one of the guard intervals;

a third one of the plurality of ports is positioned in the sample interval;

the flowline fluidly connects the two ports positioned in the guard intervals;

the flowline has no valves between the two ports positioned in the guard intervals;

the first pump is selectively fluidly coupled to the flowline via a first valve positioned above the packers; and the second pump is selectively fluidly coupled to the flowline via a second valve positioned below the packers.

10. A method, comprising:

positioning a downhole tool in a borehole adjacent a formation, wherein the downhole tool comprises:

a plurality of packers spaced along a body of the tool; and a plurality of ports positioned between ones of the plurality of packers;

then sealing a first interval of the borehole using two of the plurality of packers;

then determining, based on a density of a formation fluid, a direction to pump fluid from the first interval through a flowline fluidly coupling two of the plurality of ports that are in fluid communication with the first interval;

then pumping fluid from the first interval through the flowline in the determined direction;

then determining a condition of the fluid in the first interval;

then, based on the condition of the fluid, sealing a second interval of the borehole within the first interval using another two of the plurality of packers located within the first interval; and then pumping fluid from the second interval to collect a fluid sample from the formation.

11. The method of claim 10 wherein determining the direction to pump fluid from the first interval based on the density of the formation fluid comprises comparing the density of the formation fluid to a density of a wellbore fluid and determining to pump the fluid through the flowline in an uphole direction when the density of the formation fluid is greater than the density of the wellbore fluid.

12. The method of claim 10 wherein pumping the fluid from the first interval in the determined direction comprises activating a first pump positioned uphole relative to the plurality of packers or activating a second pump positioned downhole relative to the plurality of packers.

13. The method of claim 10 wherein pumping the fluid from the first interval in the determined direction comprises pumping the fluid via at least two of the plurality of ports in the first interval at the same time, the at least two ports associated with respective guard intervals within the first interval.

14. The method of claim 10 further comprising measuring a property of a fluid in the first interval and changing the direction to pump the fluid based on the measured property.

15. An apparatus, comprising:

a downhole tool having a body including a plurality of packers and a plurality of ports between ones of the plurality of packers, the plurality of packers and the plurality of ports spaced along a longitudinal axis of the body;

a first pump disposed in the downhole tool;

a second pump disposed in the downhole tool; and a control module operable to:

establish a first sealed borehole interval via operation of at least two of the plurality of packers, wherein at least three of the plurality of ports are positioned within the first sealed borehole interval;

then distinguish first and second different fluids in the sealed borehole interval by obtaining first and second densities respective of the first and second fluids;

then cause the first pump to pump the first fluid from the first sealed borehole interval in an uphole direction; and then cause the second pump to pump the second fluid from the first sealed borehole interval in a downhole direction while the first pump pumps the first fluid;

then establish a second sealed borehole interval within the first sealed borehole interval via operation of at least two other packers of the plurality of packers, wherein at least one of the plurality of ports is positioned between the at least two other packers;

then collecting a sample of a formation fluid from the second sealed borehole interval.

16. The apparatus of claim 15 wherein the first pump is disposed in the downhole tool uphole from the plurality of packers and the second pump is disposed in the downhole tool downhole from the plurality of packers.

17. The apparatus of claim 15 wherein the plurality of packers comprise four packers.

18. The apparatus of claim 15 wherein the first pump pumps the fluid out of the downhole tool into the borehole at a location above the plurality of packers, wherein the second pump pumps the fluid out of the downhole tool into the borehole at a location below the plurality of packers.

19. The apparatus of claim 15 wherein the first pump pumps the first fluid in the uphole direction when the density of the first fluid is less than the density of the second fluid, wherein the second pump pumps the second fluid in the downhole direction when the density of the second fluid is greater than the density of the first fluid.

* * * * *